US008888070B2

(12) United States Patent
Olesen

(10) Patent No.: US 8,888,070 B2
(45) Date of Patent: Nov. 18, 2014

(54) SCISSOR LIFT AND USE OF A SCISSOR LIFT

(71) Applicant: develtex ApS, Herning (DK)

(72) Inventor: Martin Olesen, Viborg (DK)

(73) Assignee: develtex ApS (DK)

( * ) Notice: Subject to any disclaimer, the term of this patent is extended or adjusted under 35 U.S.C. 154(b) by 0 days.

(21) Appl. No.: 13/911,360

(22) Filed: Jun. 6, 2013

(65) Prior Publication Data

US 2013/0341984 A1 Dec. 26, 2013

(30) Foreign Application Priority Data

Jun. 20, 2012 (DK) ..... 2012 70348

(51) Int. Cl.
*B66F 7/06* (2006.01)
*A61G 5/10* (2006.01)

(52) U.S. Cl.
CPC ..... *B66F 7/065* (2013.01); *B66F 7/0608* (2013.01); *A61G 5/1059* (2013.01)
USPC ..... 254/9 C; 187/211; 187/269

(58) Field of Classification Search
CPC ..... B66F 7/065; B66F 3/22; B66F 11/042
USPC ..... 254/122, 9 C; 187/269, 211; 74/39
See application file for complete search history.

(56) References Cited

U.S. PATENT DOCUMENTS

| | | | | |
|---|---|---|---|---|
| 3,237,921 | A * | 3/1966 | Jay | 254/122 |
| 3,472,183 | A * | 10/1969 | Goodman | 108/147 |
| 4,114,854 | A * | 9/1978 | Clark | 254/122 |
| 5,222,717 | A * | 6/1993 | Traficant | 254/122 |
| 6,679,479 | B1 * | 1/2004 | Watkins | 254/9 C |
| 7,225,898 | B2 * | 6/2007 | Bourgeois | 187/200 |
| 7,413,056 | B2 * | 8/2008 | Gonzi et al. | 187/269 |
| 7,552,683 | B2 * | 6/2009 | Hayashi | 104/89 |
| 8,015,638 | B2 * | 9/2011 | Shimada et al. | 5/611 |
| 2004/0000664 | A1 | 1/2004 | Watkins | |
| 2013/0037765 | A1 * | 2/2013 | Bleeker et al. | 254/122 |
| 2013/0341984 | A1 * | 12/2013 | Olesen | 297/344.15 |

FOREIGN PATENT DOCUMENTS

| | | | | |
|---|---|---|---|---|
| EP | 1384697 | A1 | 1/2004 | |
| EP | 2186769 | A1 | 5/2010 | |
| GB | 2267695 | A * | 12/1993 | B66F 9/08 |
| JP | 351154882 | U | 12/1976 | |
| JP | 52159576 | U | 12/1977 | |
| SU | 751792 | A1 | 7/1980 | |
| WO | 9962813 | A1 | 12/1999 | |
| WO | 0021478 | A1 | 4/2000 | |

OTHER PUBLICATIONS

Danish Search Report issued Mar. 13, 2013 re: PA 2012 70348; citing: JP52159576 U, GB 2267695 A, US 20040000664 A1, SU 751792 Al and JP 351154882 U.

* cited by examiner

*Primary Examiner* — Lee D Wilson
*Assistant Examiner* — Jamal Daniel
(74) *Attorney, Agent, or Firm* — Cantor Colburn LLP

(57) ABSTRACT

Disclosed is a scissor lift including a bottom frame, a top frame, a scissor mechanism arranged between the bottom frame and the top frame to displace the bottom frame and the top frame in relation to each other by means of the force provided by a linear actuator, a gearing arranged between the scissor mechanism and the linear actuator, where the linear actuator has a linear actuator point of attack at one end of a lever arm of the gearing, where the bottom frame is connected to a bottom frame point of attack at another end of the lever arm and where the scissor mechanism is connected to the lever arm through a lever arm pivotal joint arranged between the linear actuator point of attack and the bottom frame point of attack.

14 Claims, 2 Drawing Sheets

SCISSOR LIFT AND USE OF A SCISSOR LIFT

FIELD OF THE INVENTION

Figure 1:
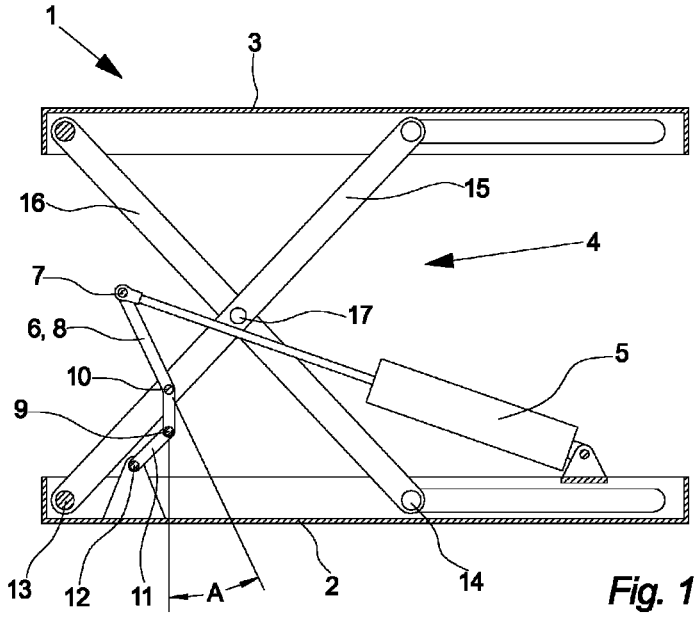

The invention relates to a scissor lift and use of a scissor lift.

BACKGROUND OF THE INVENTION

A scissor lift is a type of lift that can usually only move vertically. The mechanism to achieve this is the use of linked, folding supports in a single or criss-cross "X" pattern, known as a scissor mechanism or pantograph. The upward motion is achieved by the application of pressure to the lowest set of supports, elongating the crossing pattern, and propelling a platform vertically.

The extension and contraction of the scissor action can e.g. be hydraulic, pneumatic or mechanical (via a leadscrew or rack and pinion system). In hydraulic and pneumatic systems, it may require no power to enter "descent" mode, but rather a simple release of hydraulic or pneumatic pressure. This is the main reason that these methods of powering the lifts are preferred, as it allows a fail-safe option of returning the platform to a contracted state by release of a manual valve.

However, the power required to move the platform upwards is very uneven over the full stroke of the platform in a traditional scissor lift design. The power required to extend the lift at the beginning of the stroke is up to or even more than ten times greater than the power required to move the lift upwards at the end of the stroke, under the same load.

Thus, from the international patent application WO 99/62813 it is therefore known to provide a scissor lift with a gearing mechanism which ensures that the power required to move the platform upwards is more evenly distributed over the full stroke of the platform. However, the lift according to WO 99/62813 still requires up to 30% more power to move the platform at the beginning of the stroke than at the end of the stroke.

The invention therefore provides for scissor lift with a more advantageous power requirement distribution during the entire stroke.

THE INVENTION

The invention provides for a scissor lift comprising a bottom frame and a top frame. The scissor lift also comprises a scissor mechanism arranged between the bottom frame and the top frame to displace the bottom frame and the top frame in relation to each other by means of the force provided by a linear actuator. The scissor lift is characterized in that the scissor lift further comprises a gearing arranged between the scissor mechanism and the linear actuator, wherein the linear actuator has a linear actuator point of attack at one end of a lever arm of the gearing, wherein the bottom frame is connected to a bottom frame point of attack at another end of the lever arm and wherein the scissor mechanism is connected to the lever arm through a lever arm pivotal joint arranged between the linear actuator point of attack and the bottom frame point of attack.

Providing a gearing between the scissor mechanism and the linear actuator is advantageous in that it enables a more even power requirement during the full stroke of the scissor lift, while at the same time allowing a compact lift design. And forming the gearing by means of a lever arm rotatably mounted on the scissor mechanism and directly or indirectly connected to the bottom frame and the linear actuator at either ends of the lever arm, is advantageous in that it enables that the linear actuator can act on the scissor mechanism through a lever mechanism which enables that force required to move the top frame 10 mm when the scissor lift in a collapsed state is substantially the same as the force required to move the scissor lift 10 mm in an extended state, given that the load on the lift is the same.

I should be noted that the term "point of attack" in this context means that the linear actuator and the bottom frame are directly or indirectly connected to the lever arm at these points of attack. I.e. this term does not exclude that further arms, devices or other are arranged between e.g. the bottom frame and the bottom frame point of attack as long as the bottom frame is at least indirectly connected at the bottom frame point of attack.

I should be noted that by the terms "top frame" and "bottom frame" is to be understood any kind of platform, strut arrangement, plate construction or any other kind of frame structure in the broadest sense of the word.

In an aspect of the invention, said bottom frame is connected to said bottom frame point of attack on said lever arm through a tilt arm extending between a bottom frame rotatable joint of said bottom frame and said bottom frame point of attack on said lever arm.

Connecting the lever arm to the bottom frame through a tilt arm is particularly advantageous in that it first of all enables that the force required to extend the lift is substantially the same during the entire stroke. Secondly, the tilt arm allows for a more compact gearing design in that the bottom frame point of attack on the lever arm—and thereby the entire lever arm—can move up and down in accordance with the extension of the scissor lift. And finally the tilt arm allows the gearing to be designed without internal tensions in that it is very difficult to design and manufacture the gearing without the risk of undesired stress concentrations building up in parts of the gearing and/or the scissor mechanism during at least parts of the entire stroke. However, by the introduction of an intermediate arm between the lever arm and the bottom frame this risk is severely reduced.

In an aspect of the invention, the distance between said linear actuator point of attack and said lever arm pivotal joint on said lever arm is between 10% and 500%, preferably between 50% and 400% and most preferred between 100% and 340% longer than the distance between said bottom frame point of attack and said lever arm pivotal joint on said lever arm.

If the distance between the linear actuator point of attack and the lever arm pivotal joint becomes too short in relation to the distance between the bottom frame point of attack and the lever arm pivotal joint, the lever effect of the lever arm is reduced to a point where the force requirement can no longer be distributed evenly over the entire stroke. And if the distance between the linear actuator point of attack and the lever arm pivotal joint becomes too long in relation to the distance between the bottom frame point of attack and the lever arm pivotal joint, the effective stroke of the lift is reduced too much and the gearing becomes too space demanding. Thus, the present length ratio ranges provides for an advantageous relationship between force requirement distribution and efficiency.

In an aspect of the invention, said scissor mechanism is connected to said bottom frame through a fixed rotatable joint and a displaceable joint and wherein said lever arm is connected to said bottom frame through a bottom frame rotatable joint which is elevated in relation to a plane through said fixed rotatable joint and said displaceable rotatable joint in a direction towards said top frame.

Elevating the bottom frame rotatable joint in relation to the fixed rotatable joint and the displaceable joint is advantageous in that it allows that the lever arm can travel below the bottom frame rotatable joint without colliding with the bottom frame which allows for a more flexible and compact gearing design.

In an aspect of the invention, said linear actuator point of attack and/or said bottom frame point of attack are formed as rotatable joints.

Hereby is achieved an advantageous embodiment of the invention.

In an aspect of the invention, said linear actuator point of attack and said bottom frame point of attack is arranged on said lever arm so that a line between said lever arm pivotal joint and said linear actuator point of attack and a line between said lever arm pivotal joint and said bottom frame point of attack form an angle between 2° and 80°, preferably between 10° and 60° and most preferred between 20° and 45° such as 30°.

If the angle between these two lines becomes too little the force required at the beginning of the scissor lift stroke is relatively high because the linear actuator stroke to lift stroke ratio becomes too high at the beginning of the stroke and if the angle between these two lines becomes too small the ratio becomes too small at the beginning of the stroke. Thus, the present angle ranges provides for an advantageous force requirement distribution. Furthermore, if the angle becomes to great or too small the gearing becomes more space consuming.

It should be noted that the angle between the two lines in this context is measured in relation to the situation where the lines are parallel and in continuation of each other hereby forming the a straight lever arm, where said angle is 0°.

In an aspect of the invention, said scissor mechanism comprises a first leg rotatably connected to a second leg by means of a scissor joint making said legs form an X and wherein said gearing is connected to only one of said first leg and said second leg.

Connecting the gearing to only one of the scissor legs is advantageous in that it provides for a more simple lift design and it reduces the risk of unwanted stress concentrations building up.

In an aspect of the invention, said scissor mechanism comprises a first leg rotatably connected to a second leg by means of a scissor joint making said legs form an X and wherein said first leg and said second leg extends substantially uniformly on both sides of said scissor joint.

Thus, according to this embodiment the first leg and the second leg extends substantially the same length from the scissor joint and downwards—i.e. between the scissor joint and bottom frame. And according to this embodiment the first leg and the second leg extends substantially the same length from the scissor joint and upwards. However, this does not exclude that the individual legs could have different length on either side of the scissor joint.

Forming the legs with substantially equal length on both sides of the scissor joint is advantageous in that this provides for a symmetrically scissor mechanism design that will only lift the top frame vertically.

However in another embodiment the length of the part of the legs extending between the scissor joint and the bottom frame could be different and/or the length of the parts of the legs extending between the scissor joint and the top frame could be different, thus enabling that the scissor lift may also be used for tilting the top frame in relation to the bottom frame during a lifting process i.e. while the bottom ends of the legs are moved towards each other.

In an aspect of the invention, said linear actuator is an electrical linear actuator comprising an electrical motor and a spindle drive.

Hereby is achieved an advantageous embodiment of the invention.

The invention also provides for use of a scissor lift according to any of the preceding scissor lifts for elevating the seat of a wheelchair.

If the scissor lift requires ten times as much force to lift 100 kg at the beginning of a stroke than at the ending of a stroke, the linear actuator has to have a capacity according to the requirements at the beginning of the stroke, if the capacity of the seat in the wheelchair has to be 100 kg. A linear actuator on a scissor lift according to the present invention would only have to have approximately half the capacity to lift the same load since the force requirement is substantially the same during the entire stroke. This will obviously reduce the cost of the linear actuator considerably but in relation to wheelchairs two other factor are highly important and this is size and power consumption. Reducing the capacity of the linear actuator will enable a more compact lift design and the power required to performed the lift is reduced which is particularly advantageous in relation to wheelchairs where the power source has to be transported along on the wheelchair.

FIGURES

Figure 2:
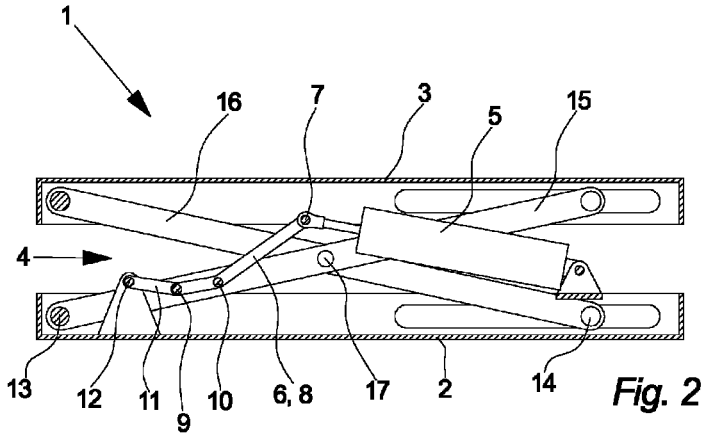
Figure 3:
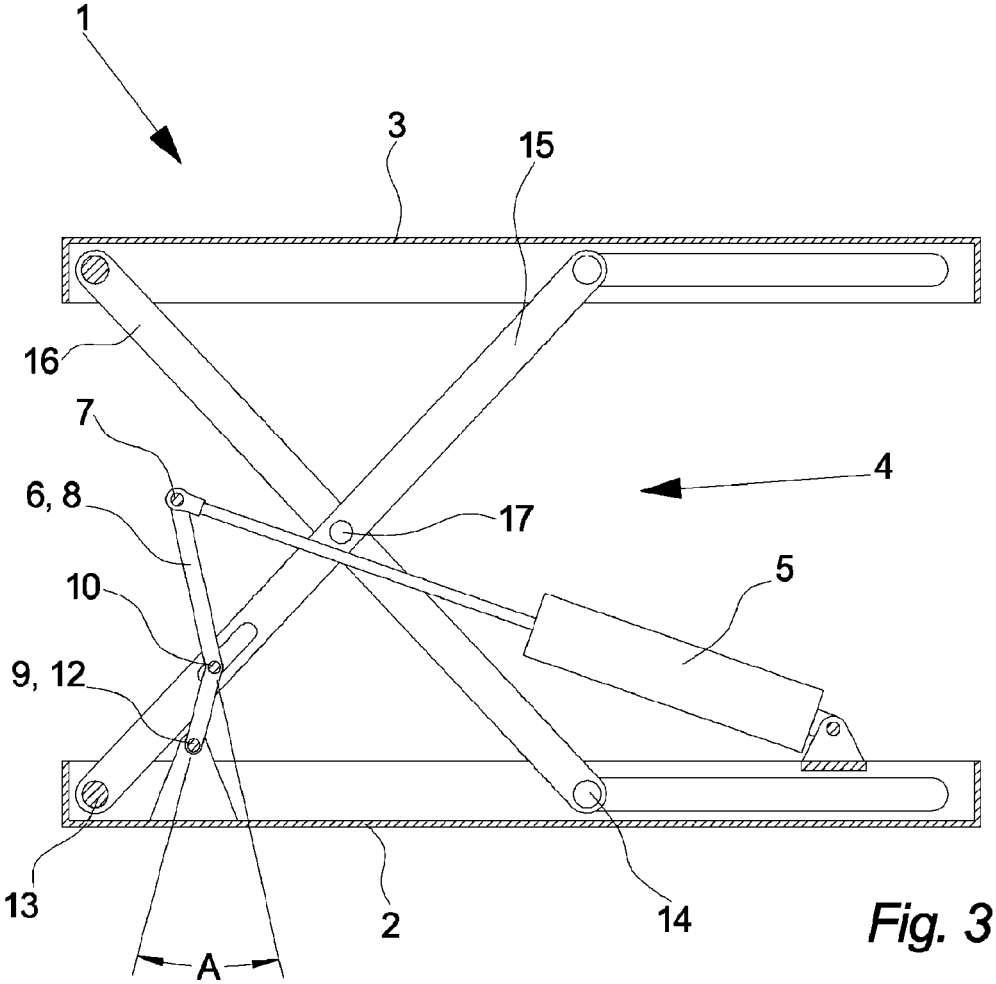

The invention will be described in the following with reference to the figures in which FIG. 1. illustrates a cross section through a scissor lift according to the invention in an elevated state, as seen from the side, FIG. 2 illustrates a cross section through the scissor lift shown in FIG. 1 approaching a fully collapsed state, as seen from the side, and FIG. 3 illustrates a cross section through another embodiment of a scissor lift according to the invention in an elevated state, as seen from the side.

DETAILED DESCRIPTION

FIG. 1 illustrates a cross section through a scissor lift 1 according to the invention in an elevated state, as seen from the side.

In this embodiment of the invention the scissor mechanism 4 is constituted by two legs 15, 16 arranged in a X by means of the rotatable scissor joint 17 allowing the upper ends and the lower ends of the legs 15, 16 to move towards or away from each other. To ensure that the top frame 3—which in this embodiment is formed as a platform—is maintained substantially parallel with the bottom frame 2—which in this embodiment is formed as a sheet metal construction—the left end of the legs 15, 16 is connected to the bottom frame 2 and the top frame 3 respectively through fixed rotatable joints 13 and the right ends are connected to displaceable joints 14. The displaceable joints 14 allows the ends of the legs 15, 16 to travel controlled back and forth while being guided by track means of the frames 2, 3.

However, in another embodiment of the invention the stroke of the scissor mechanism 4 could be doubled, tripled or more by arranging one, two or more pairs of X-arranged legs between the top frame 3 and the legs 15, 16 disclosed in FIG. 1.

In this embodiment a linear actuator 5 is at one end connected to the bottom frame 2 through a rotatable joint and the other end of the linear actuator 5 is connected directly to an end of a lever arm 8 of the gearing 6 through a rotatable joint in the linear actuator point of attack 7. However, in another embodiment of the invention an arm, a shock absorber, a spring or other devices could be arranged between the linear actuator 5 and the linear actuator point of attack 7 on the lever arm 8 so that the linear actuator 5 is indirectly connected to the lever arm 8.

In this embodiment of the invention the lift 1 is provide with only one linear actuator 5 and one gearing 6, however in another embodiment the lift 1 could comprise two, three or more linear actuators 5 and/or two, three or more gearings 6.

In this embodiment of the invention the linear actuator 5 is an electrical linear actuator comprising a spindle driven by an electrical motor but in another embodiment of the invention the linear actuator 5 could be hydraulically or pneumatically powered.

The lever arm 8 is connected to a leg 15 of the scissor mechanism 4 through a lever arm pivotal joint 10 arranged at a middle part of the lever arm 8, hereby allowing the lever arm 8 to rotate in relation to the scissor mechanism 4.

The lower end of the lever arm 8 is in this embodiment connected to a tilt arm 11 through a rotatable joint formed at the bottom frame point of attack 9 and the tilt arm 11 is connected to the bottom frame 2 through a bottom frame rotatable joint 12.

FIG. 2 illustrates a cross section through the scissor lift 1 disclosed in FIG. 1 approaching a fully collapsed state, as seen from the side.

In this embodiment of the invention the lever arm 8 is formed in an angle A of approximately 30° around the lever arm pivotal point 10 and the distance between the linear actuator point of attack 7 and the lever arm pivotal point 10 is approximately 220% longer than the distance between the bottom frame point of attack 9 and the lever arm pivotal point 10. This, in combination with a tilt arm 11 having a length approximately the same as the distance between the bottom frame point of attack 9 and the lever arm pivotal point 10 ensures that the power/lift movement ratio is substantially the same over the entire stroke of the lift 1. In other words, the gearing 6 ensures that the linear actuator 5 has to extent further per mm the lift 1 moves upwards when the lift 1 is in a collapsed state compared to when the lift 1 is at a fully extended state. The ratio of the gearing 8 thereby decreases in accordance with the total height of the lift 1 as the top frame 3 is moved upwards and increases as the top frame 3 moves downwards.

In this embodiment of the invention the bottom frame rotatable joint 12 is elevated above the bottom frame 2 and particularly above a plane extending between the fixed rotatable joint 13 and the displaceable joint 14 of the bottom frame 2 hereby among other allowing at least parts of the lever arm 8 to descend below the bottom frame rotatable joint 12 hereby providing a compact lift design.

FIG. 3 illustrates a cross section through another embodiment of a scissor lift 1 according to the invention in an elevated state, as seen from the side.

In this embodiment of the invention the lever arm 8 is connected directly to the bottom frame rotatable joint 12 at the bottom frame point of attack 9. To ensure that undesired stress concentrations does not build up in the gearing 6 or the scissor mechanism 4 and to ensure a substantially uniform power requirement over the entire stroke of the lift 1, the lever arm pivotal joint 10 can in this embodiment also be displaced in relation to the leg 15 of the scissor mechanism 4 to which it is connected. In this embodiment the leg 15 is provided with track means guiding the lever arm pivotal joint 10 in a direction substantially parallel with the longitudinal extent of the leg 15.

In the embodiment disclosed in FIGS. 1-3 the scissor lift 1 is a scissor lift 1 for being fitted beneath the seat in a wheelchair so that the height of the seat may be adjusted (by the user) e.g. to allow the user to reach higher or to bring the wheelchair user at eye level with an erect person. In such an implementation it is particularly important that the lift 1 is as compact as possible and that the power consumption is kept to a minimum since the power source—usually a battery—is fitted on the wheelchair and extensive power consumption therefore will reduce the range and flexibility of the wheelchair. However, in another embodiment of the invention the lift design according to the present invention may also advantageously be used in relation with hospital equipment such as hospital beds, in the manufacturing industry, in a car repair shop or anywhere else where compact design and low power consumption is of the essence.

The invention has been exemplified above with reference to specific examples of scissor lift 1, scissor mechanisms 4, linear actuators 5 and other. However, it should be understood that the invention is not limited to the particular examples described above but may be designed and altered in a multitude of varieties within the scope of the invention as specified in the claims.

The invention claimed is:

1. A scissor lift comprising
a bottom frame,
a top frame,
a scissor mechanism arranged between said bottom frame and said top frame to displace said bottom frame and said top frame in relation to each other by means of the force provided by
a linear actuator,
wherein said scissor lift further comprises a gearing arranged between said scissor mechanism and said linear actuator, wherein said linear actuator has a linear actuator point of attack at one end of a lever arm of said gearing, wherein said bottom frame is connected to a bottom frame point of attack at another end of said lever arm and wherein said scissor mechanism is connected to said lever arm through a lever arm pivotal joint arranged between said linear actuator point of attack and said bottom frame point of attack.

2. The scissor lift according to claim 1, wherein said bottom frame is connected to said bottom frame point of attack on said lever arm through a tilt arm extending between a bottom frame rotatable joint of said bottom frame and said bottom frame point of attack on said lever arm.

3. The scissor lift according to claim 1, wherein the distance between said linear actuator point of attack and said lever arm pivotal joint on said lever arm is between 10% and 500% longer than the distance between said bottom frame point of attack and said lever arm pivotal joint on said lever arm.

4. The scissor lift according to claim 1, wherein the distance between said linear actuator point of attack and said lever arm pivotal joint on said lever arm is between 50% and 400% longer than the distance between said bottom frame point of attack and said lever arm pivotal joint on said lever arm.

5. The scissor lift according to claim 1, wherein the distance between said linear actuator point of attack and said lever arm pivotal joint on said lever arm is between 100% and 340% longer than the distance between said bottom frame point of attack and said lever arm pivotal joint on said lever arm.

6. The scissor lift according to claim 1, wherein said scissor mechanism is connected to said bottom frame through a fixed rotatable joint and a displaceable joint and wherein said lever arm is connected to said bottom frame through a bottom frame rotatable joint which is elevated in relation to a plane through said fixed rotatable joint and said displaceable rotatable joint in a direction towards said top frame.

7. The scissor lift according to claim 1, wherein said linear actuator point of attack is formed as a rotatable joint.

8. The scissor lift according to claim 1, wherein said bottom frame point of attack is formed as a rotatable joint.

9. The scissor lift according to claim 1, wherein said linear actuator point of attack and said bottom frame point of attack is arranged on said lever arm so that a line between said lever arm pivotal joint and said linear actuator point of attack and a line between said lever arm pivotal joint and said bottom frame point of attack form an angle between 2° and 80°.

10. The scissor lift according to claim 1, wherein said linear actuator point of attack and said bottom frame point of attack is arranged on said lever arm so that a line between said lever arm pivotal joint and said linear actuator point of attack and a line between said lever arm pivotal joint and said bottom frame point of attack form an angle between 10° and 60°.

11. The scissor lift according to claim 1, wherein said linear actuator point of attack and said bottom frame point of attack is arranged on said lever arm so that a line between said lever arm pivotal joint and said linear actuator point of attack and a line between said lever arm pivotal joint and said bottom frame point of attack form an angle between 20° and 45° such as 30°.

12. The scissor lift according to claim 1, wherein said scissor mechanism comprises a first leg rotatably connected to a second leg by means of a scissor joint making said legs form an X and wherein said gearing is connected to only one of said first leg and said second leg.

13. The scissor lift according to claim 1, wherein said scissor mechanism comprises a first leg rotatably connected to a second leg by means of a scissor joint making said legs form an X and wherein said first leg and said second leg extends substantially uniformly on both sides of said scissor joint.

14. The scissor lift according to claim 1, wherein said linear actuator is an electrical linear actuator comprising an electrical motor and a spindle drive.

* * * * *